US006443515B1

(12) United States Patent
Wu

(10) Patent No.: US 6,443,515 B1
(45) Date of Patent: Sep. 3, 2002

(54) HOLDING WRENCH

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 0 days.

(21) Appl. No.: 09/866,673

(22) Filed: May 30, 2001

(51) Int. Cl.[7] ..... B25B 13/10

(52) U.S. Cl. ..... 294/16; 294/902; 81/423; 269/282

(58) Field of Search ..... 294/2, 3, 16, 24, 294/50.6, 50.9, 51, 106, 99.2, 902; 269/280–284; 81/421–423, 176.3, 178, 180.1, 185.2, 90.1; 7/125, 138, 139

(56) References Cited

U.S. PATENT DOCUMENTS 3,010,347 A * 11/1961 Kron ..... 7/139
5,070,564 A * 12/1991 Fey ..... 254/131
5,469,766 A * 11/1995 Hodges ..... 81/176.3
5,647,625 A * 7/1997 Sawdon ..... 269/282
5,884,540 A * 3/1999 Mo ..... 81/423

* cited by examiner

*Primary Examiner*—Dean J. Kramer

(57) ABSTRACT

A holding wrench includes a body having a first arm plate having a first end and a second end, and a second arm plate having a first end pivoted on the mediate portion of the first arm plate. A first holding assembly includes two first holding members each having a first end secured on the second end of the first arm plate and the second arm plate respectively, and a second end defining a snap recess. A second holding assembly includes two second holding members each having a threaded post selectively screwed into the first arm plate and the second arm plate respectively, thereby selectively securing the two second holding members to the first arm plate and the second arm plate respectively. The threaded post has a first end provided with an enlarged head, and a second end formed with an insertion stub.

7 Claims, 10 Drawing Sheets

HOLDING WRENCH

BACKGROUND OF THE INVENTION

1. Field of the Invention

The present invention relates to a holding wrench that can be used to mate with rotation workpieces of different structures.

2. Description of the Related Art

A first conventional holding wrench in accordance with the prior art shown in FIGS. 1–3 comprises a main plate 1 having a first end provided with a handle 101 and a second end formed with a jaw 102 defining a snap recess 1022, a secondary plate 2 having a first end pivoted to the main plate 1 and a second end formed with a jaw 201 defining a snap recess 2012.

In operation, referring to FIGS. 2 and 3, the wheel axle 301 of the fan blade wheel 3 is provided with a belt wheel 4 which drives the fan blade wheel 3 to rotate. The distal end of the wheel axle 301 passes through the belt wheel 4 and is screwed by a nut 3011. The belt wheel 4 is provided with a plurality of lugs 401. When the operator wishes to detach the fan blade wheel 3, the jaws 102 and 201 are locked on two opposite lugs 401 which are retained in the snaps recesses 1022 and 2012, thereby controlling the belt wheel 4 and the fan blade wheel 3. Then, the nut 3011 can be driven by another wrench to rotate relative to the wheel axle 301, thereby unscrewing the nut 3011, and further detaching the fan blade wheel 3.

A second conventional holding wrench in accordance with the prior art shown in FIGS. 4 and 5 comprises a main plate 5 having a first end provided with a handle 501 and a second end formed with two opposite jaws 503 each provided with an insertion pin 504.

In operation, referring to FIG. 5, the holding wrench can be used to assemble and dismantle a rotation workpiece 6 having a larger diameter such as the belt wheel, sprocket or the like. The rotation workpiece 6 is formed with a plurality of slots 601. When the operator wishes to detach the rotation workpiece 6, the insertion pins 504 can be inserted into two opposite slots 601, thereby positioning the rotation workpiece 6. Then, the screw or nut on the rotation workpiece 6 can be driven by another wrench to rotate relative to the rotation workpiece 6, thereby unscrewing the screw or nut and thereby further detaching the rotation workpiece 6. However, the operator has to prepare multiple tools so as to satisfy the various requirements of the working process, thereby causing inconvenience to the operator in use.

SUMMARY OF THE INVENTION

The present invention has arisen to mitigate and/or obviate the disadvantage of the conventional holding wrench.

The primary objective of the present invention is to provide a holding wrench that can be used to mate with rotation workpieces of different structures.

In accordance with the present invention, there is provided a holding wrench comprising:

a body, the body including a first arm plate and a second arm plate, the first arm plate having a first end provided with a handle and a second end defining a first screw hole, the second arm plate having a first end pivotally mounted on a mediate portion of the first arm plate and a second end defining a second screw hole;

a first holding assembly selectively secured on the body and including two symmetric first holding members each having a first end selectively and releasably secured on the second end of the first arm plate and the second arm plate, and each having a second end defining a snap recess, the snap recesses of the two first holding members facing each other, the first end of each of the two first holding members defining a through hole aligning with the first screw hole of the first arm plate and the second screw hole of the second arm plate respectively, two locking bolts each respectively extended through the through hole of each of the two first holding members, and each respectively screwed into the first screw hole of the first arm plate and the second screw hole of the second arm plate, thereby securing the two first holding members to the first arm plate and the second arm plate respectively; and a second holding assembly selectively secured on the body and including two second holding members each having a threaded post selectively screwed into the first screw hole of the first arm plate and the second screw hole of the second arm plate respectively, thereby selectively securing the two second holding members to the first arm plate and the second arm plate respectively, the threaded post of each of the two second holding members having a first end provided with an enlarged head rested on a first side of the first screw hole of the first arm plate and the second screw hole of the second arm plate respectively, and having a second end formed with an insertion stub protruded outward from a second side of the first screw hole of the first arm plate and the second screw hole of the second arm plate respectively.

Further benefits and advantages of the present invention will become apparent after a careful reading of the detailed description with appropriate reference to the accompanying drawings.

DETAILED DESCRIPTION OF THE INVENTION

Figure 1:
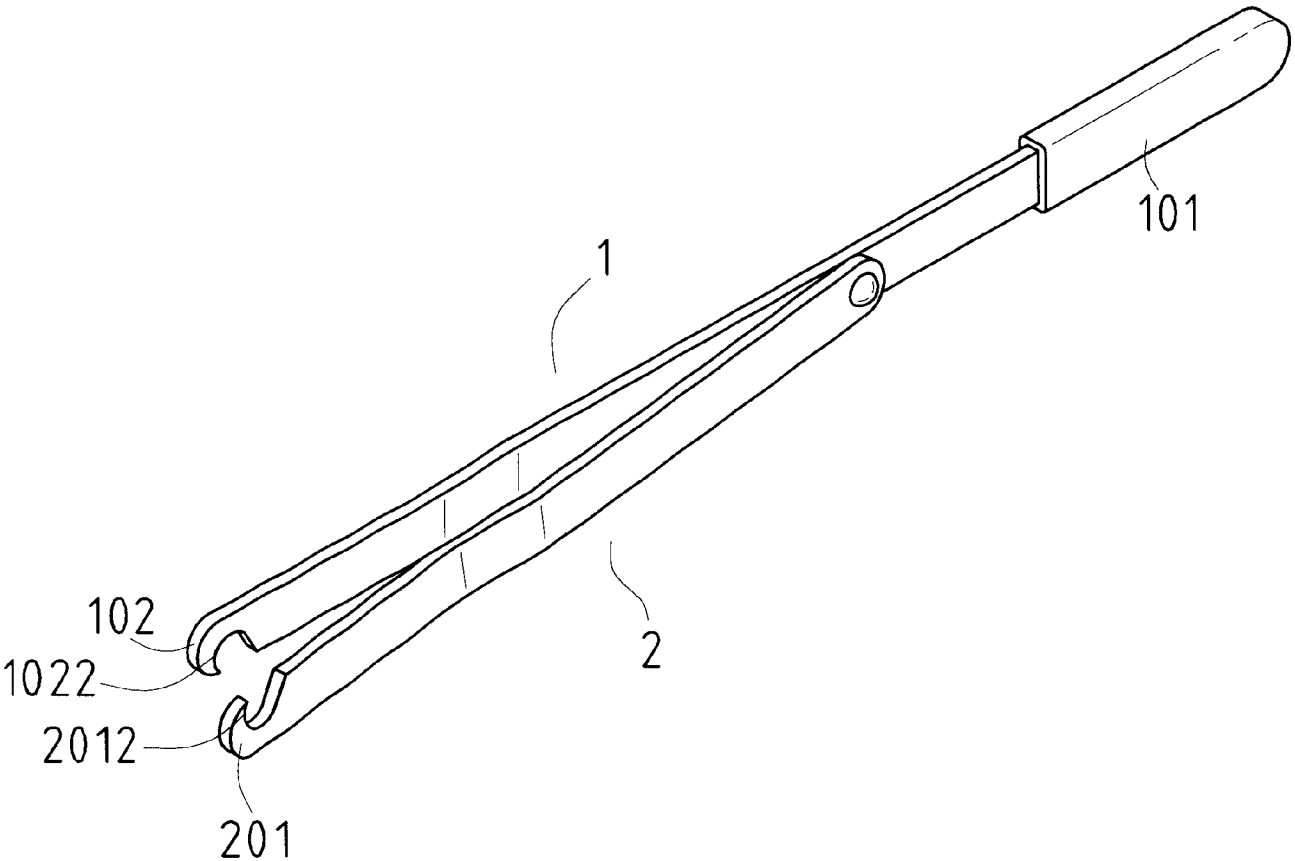
FIG. 1 PRIOR ART
FIG. 1 is a perspective view of a first conventional holding wrench in accordance with the prior art.
Figure 2:
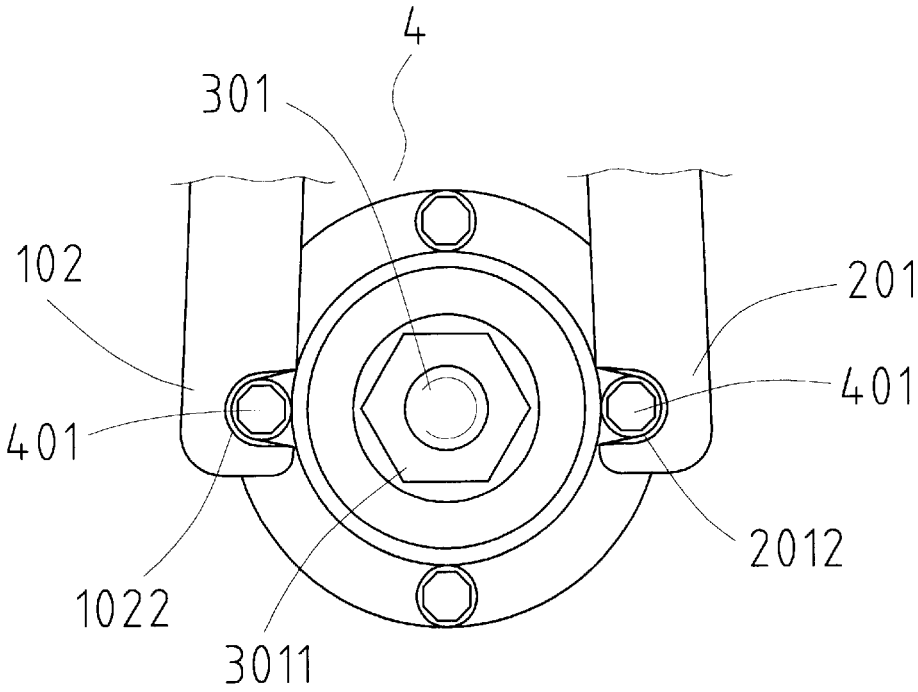
FIG. 2 PRIOR ART
FIG. 2 is a schematic rear plan view of the first conventional holding wrench as shown in FIG. 1 in use.
Figure 3:
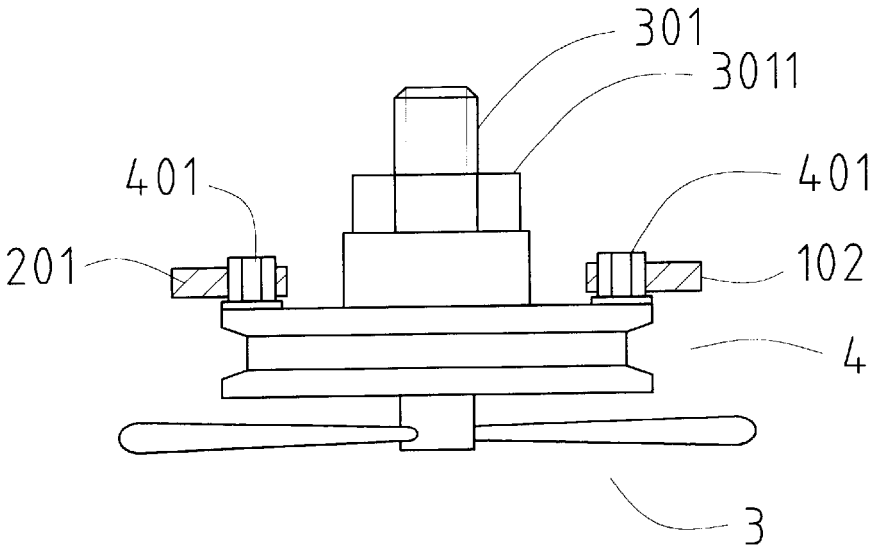
FIG. 3 PRIOR ART
FIG. 3 is a schematic top plan view of the first conventional holding wrench as shown in FIG. 1 in use.
Figure 4:
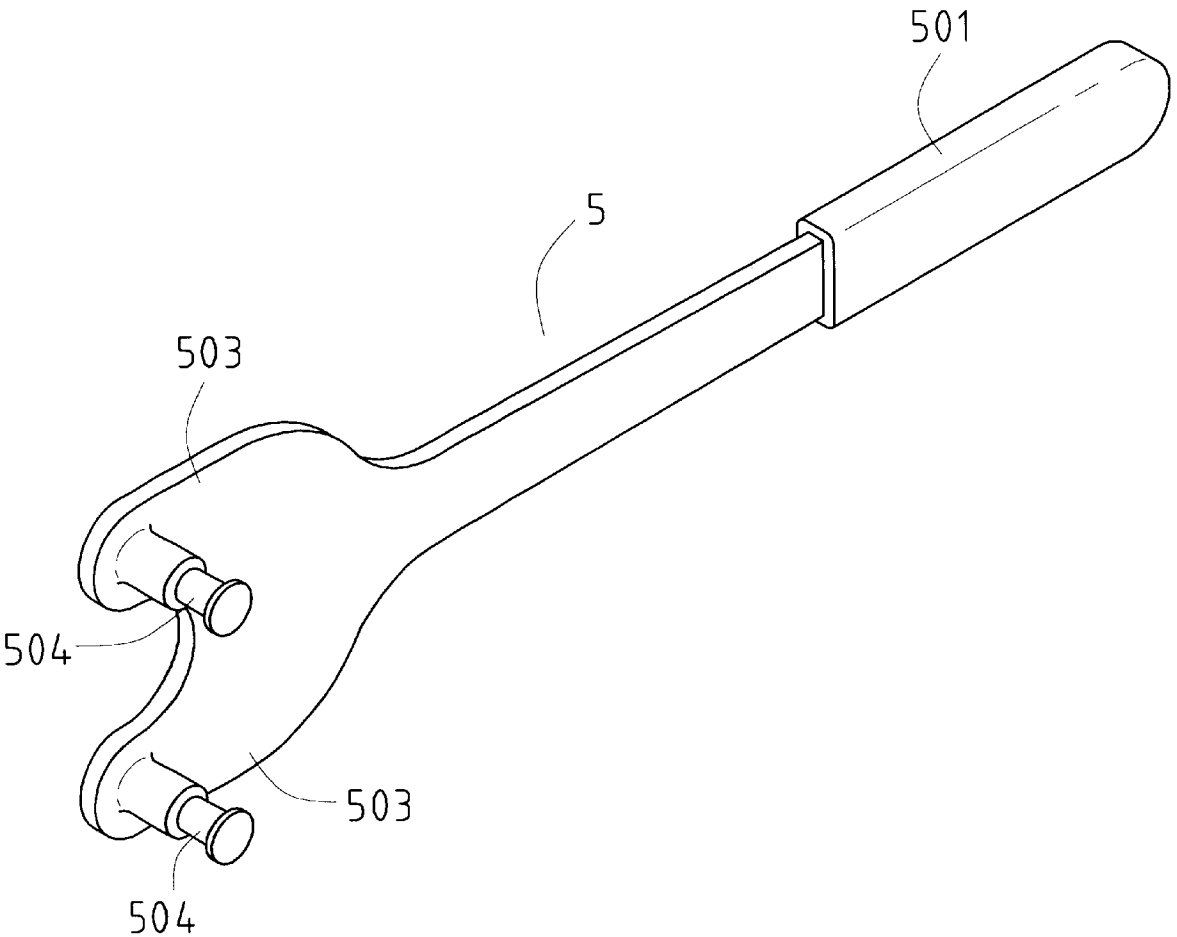
FIG. 4 PRIOR ART
FIG. 4 is a perspective view of a second conventional holding wrench in accordance with the prior art.
Figure 5:
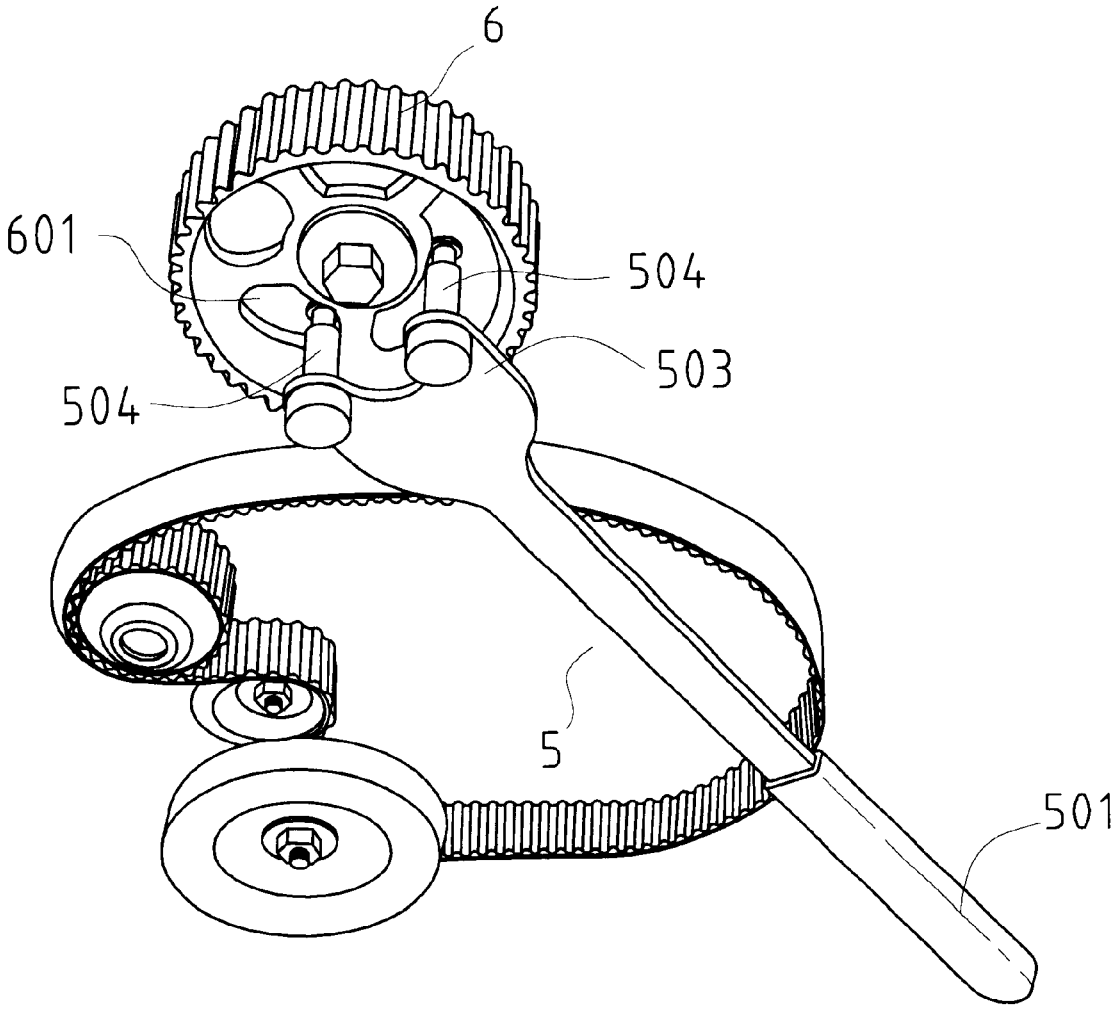
FIG. 5 PRIOR ART
FIG. 5 is a schematic view of the second conventional holding wrench as shown in FIG. 4 in use.
Figure 6:
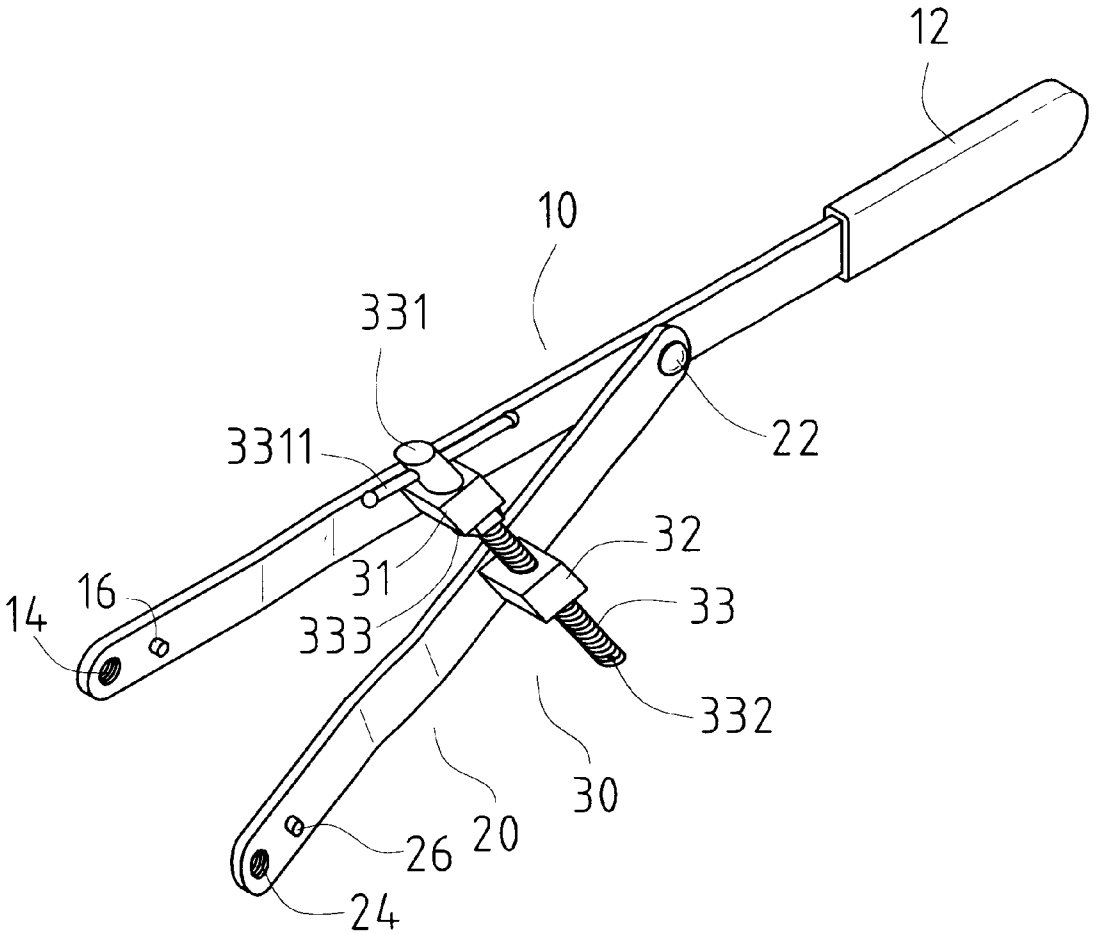
FIG. 6 is a perspective view of a holding wrench in accordance with a first embodiment of the present invention.
Figure 7:
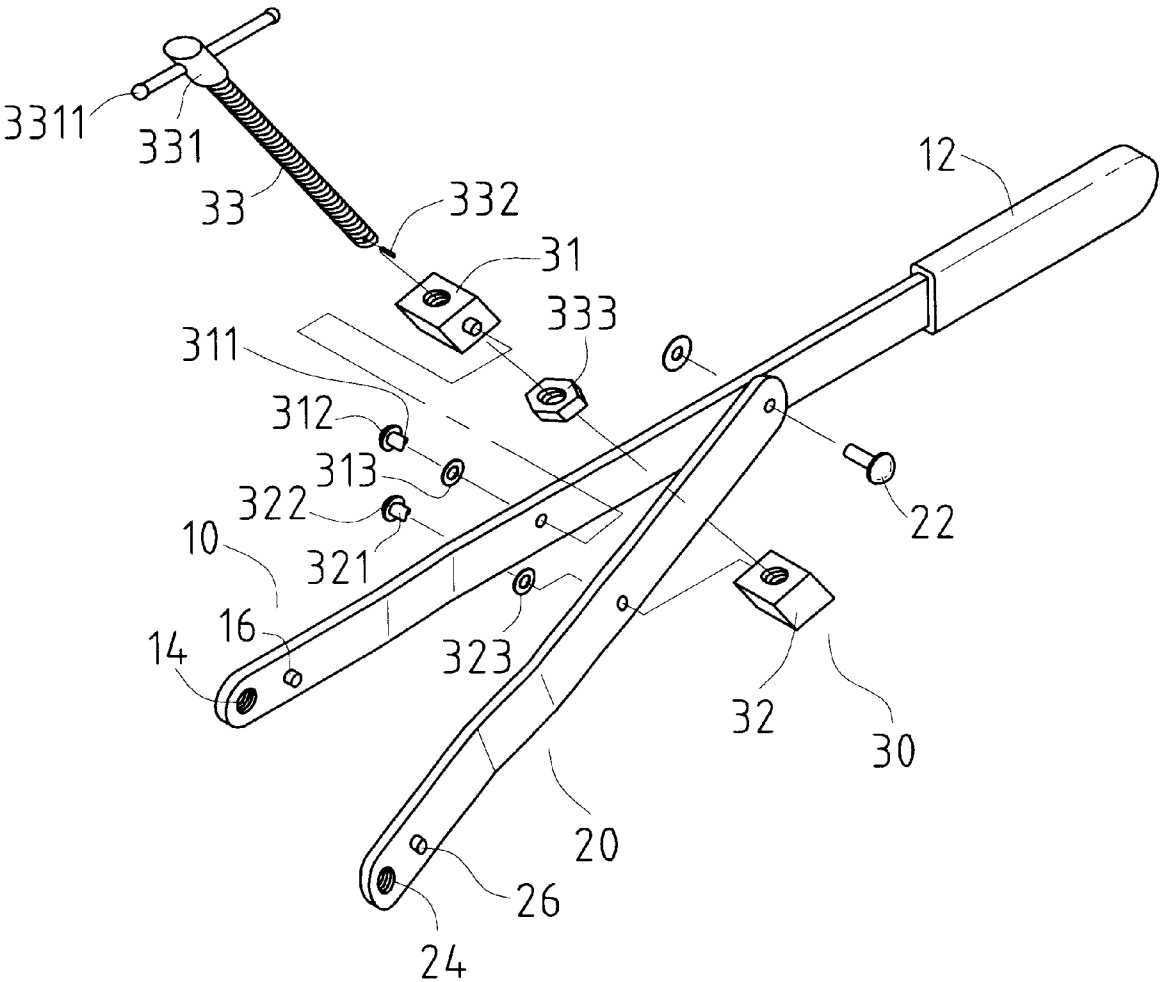
FIG. 7 is an exploded perspective view of the holding wrench as shown in FIG. 6.

Referring to the drawings and initially to FIGS. 6 and 7, a holding wrench in accordance with a first embodiment of the present invention comprises a body, and a regulating device 30.

The body includes a first arm plate 10 and a second arm plate 20. The first arm plate 10 has a first end provided with a handle 12 and a second end defining a first screw hole 14. The second arm plate 20 has a first end pivotally mounted on the mediate portion of the first arm plate 10 by a pivot axle 22, and a second end defining a second screw hole 24.

The first arm plate 10 is provided with a first locking stub 16 located adjacent to the first screw hole 14, and the second arm plate 20 is provided with a second locking stub 26 located adjacent to the second screw hole 24, so that a holding assembly (which will be described later) may be selectively mounted on the second end of the first arm plate 10 and the second arm plate 20.

The regulating device 30 includes a first seat 31, a second seat 32, and a threaded rod 33. The first seat 31 is pivotally mounted on the first arm plate 10. The second seat 32 is pivotally mounted on the second arm plate 20. The threaded rod 33 has a first end extended through the first seat 31 and a second end extended through the second seat 32. An enlarged catch block 331 is secured on the first end of the threaded rod 33 and is rested on the first seat 31. A limit nut 333 is mounted on the threaded rod 33 and is located between the first seat 31 and the second seat 32, so that the first seat 31 is limited between the catch block 331 and the limit nut 333. A retaining pin 332 is secured on the second end of the threaded rod 33, so that the first seat 31 and the second seat 32 are limited between the catch block 331 and the retaining pin 332. A drive rod 3311 is transversely extended through the catch block 331 for rotating the threaded rod 33, so that the first seat 31 and the second seat 32 can be moved relative to each other, and so that the first arm plate 10 and the second arm plate 20 can be pivoted relative to each other.

The first seat 31 has a bottom side formed with a first nail 311 which 14 is extended through the first arm plate 10 and is expanded to form a first head 312, so that the first seat 31 is pivoted on the first arm plate 10. The second seat 32 has a bottom side formed with a second nail 321 which is extended through the second arm plate 20 and is expanded to form a second head 322, so that the second seat 32 is pivoted on the second arm plate 20.

The first nail 311 of the first seat 31 is pivoted with a first washer 313 located between the first head 312 and the first arm plate 10, and the second nail 321 of the second seat 32 is pivoted with a second washer 323 located between the second head 322 and the second arm plate 20.

In operation, the drive rod 3311 can be driven to rotate the threaded rod 33, so that the first seat 31 and the second seat 32 can be moved relative to each other. In such a manner, the first arm plate 10 and the second arm plate 20 can be pivoted relative to each other due to the relative movement between the first seat 31 and the second seat 32, thereby being capable of adjusting and regulating the included angle between the first arm plate 10 and the second arm plate 20 in a stable and rigid manner.

Figure 8:
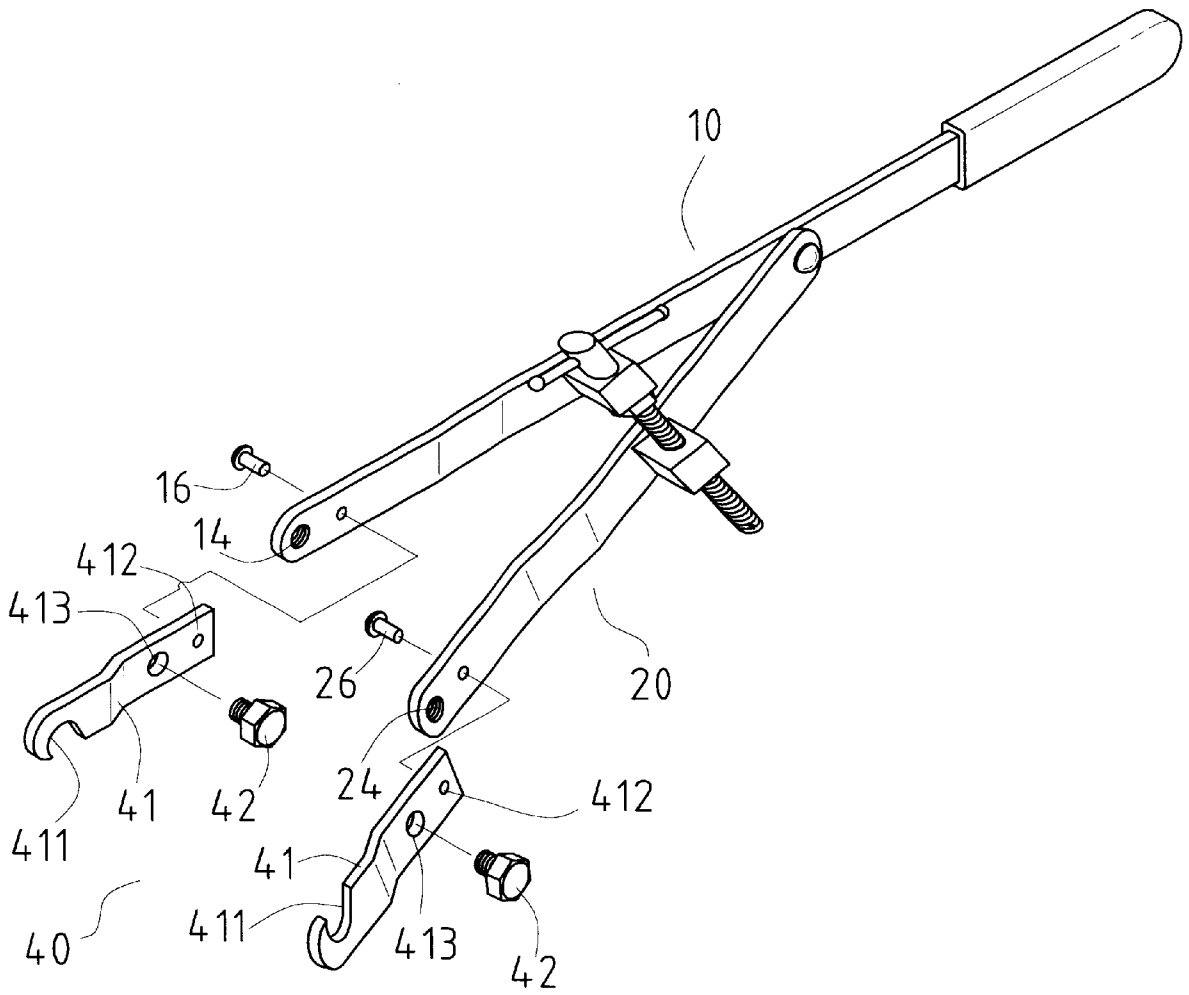
FIG. 8 is a perspective view of a holding wrench in accordance with a second embodiment of the present invention.

Referring to FIG. 8, in accordance with a second embodiment of the present invention, a first holding assembly 40 is selectively secured on the body and includes two symmetric first holding members 41 each having a first end selectively and releasably secured on the second end of the first arm plate 10 and the second arm plate 20, and each having a second end defining a snap recess 411. The snap recesses 411 of the two first holding members 41 face each other. The first end of each of the two first holding members 41 defines a through hole 413 aligning with the first screw hole 14 of the first arm plate 10 and the second screw hole 24 of the second arm plate 20 respectively. Two locking bolts 42 are each respectively extended through the through hole 413 of each of the two first holding members 41, and are each respectively screwed into the first screw hole 14 of the first arm plate 10 and the second screw hole 24 of the second arm plate 20, thereby securing the two first holding members 41 to the first arm plate 10 and the second arm plate 20 respectively.

The first end of each of the two first holding members 41 defines a stub passage hole 412 located adjacent to the through hole 413. The first arm plate 10 is provided with a first locking stub 16 located adjacent to the first screw hole 14, and the second arm plate 20 is provided with a second locking stub 26 located adjacent to the second screw hole 24. The first locking stub 16 of the first arm plate 10 and the second locking stub 26 of the second arm plate 20 are respectively inserted into the stub passage holes 412 of the two first holding members 41, thereby positioning the two first holding members 41 on the first arm plate 10 and the second arm plate 20 respectively.

In such a manner, the first holding assembly 40 can be used to mate with rotation workpieces of different structures.

Figure 9:
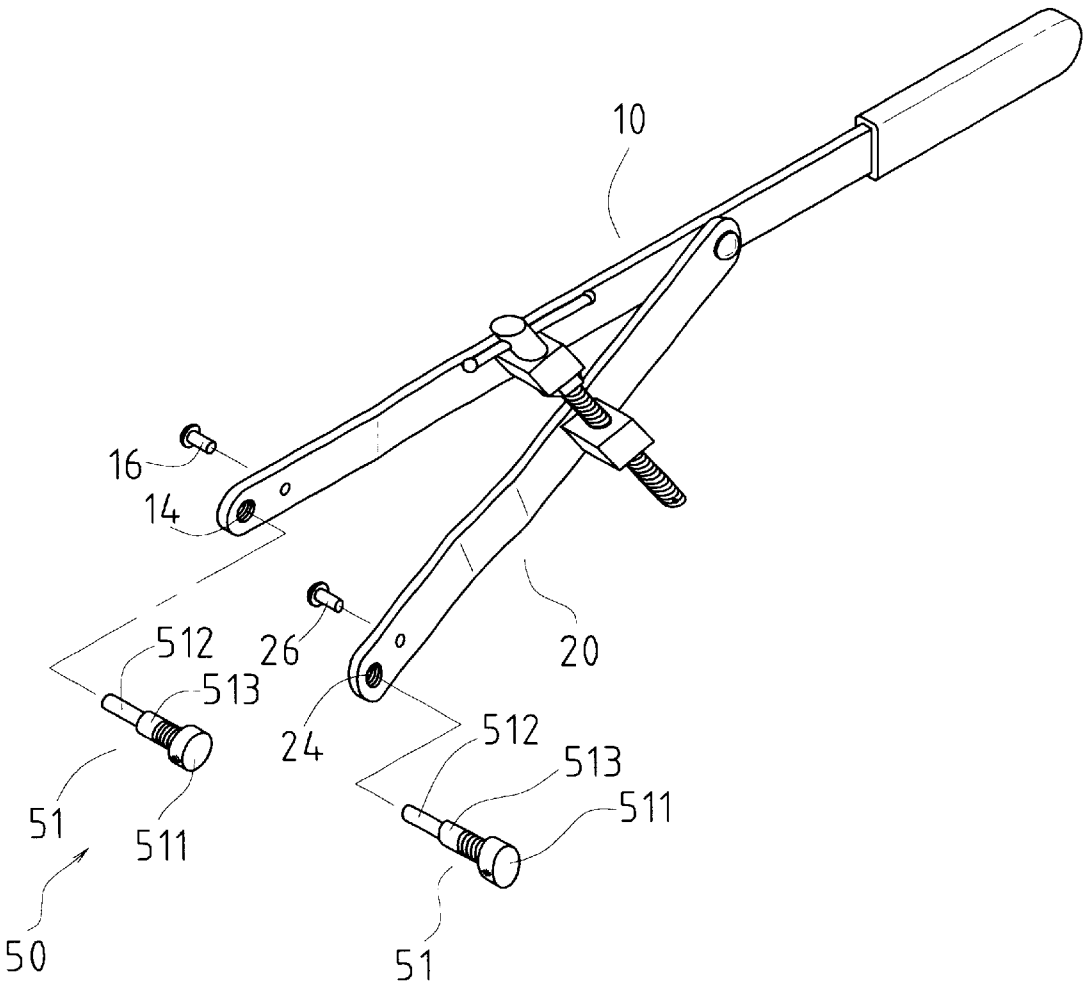
FIG. 9 is a perspective view of a holding wrench in accordance with a third embodiment of the present invention.

Referring to FIG. 9, in accordance with a third embodiment of the present invention, a second holding assembly 50 is selectively secured on the body and includes two second holding members 51 each having a threaded post 513 selectively screwed into the first screw hole 14 of the first arm plate 10 and the second screw hole 24 of the second arm plate 20 respectively, thereby selectively securing the two second holding members 51 to the first arm plate 10 and the second arm plate 20 respectively.

The threaded post 513 of each of the two second holding members 51 has a first end provided with an enlarged head 511 rested on a first side of the first screw hole 14 of the first arm plate 10 and the second screw hole 24 of the second arm plate 20 respectively, and has a second end formed with an insertion stub 512 protruded outward from a second side of the first screw hole 14 of the first arm plate 10 and the second screw hole 24 of the second arm plate 20 respectively.

In such a manner, the second holding assembly 50 can be used to mate with rotation workpieces of different structures.

Figure 10:
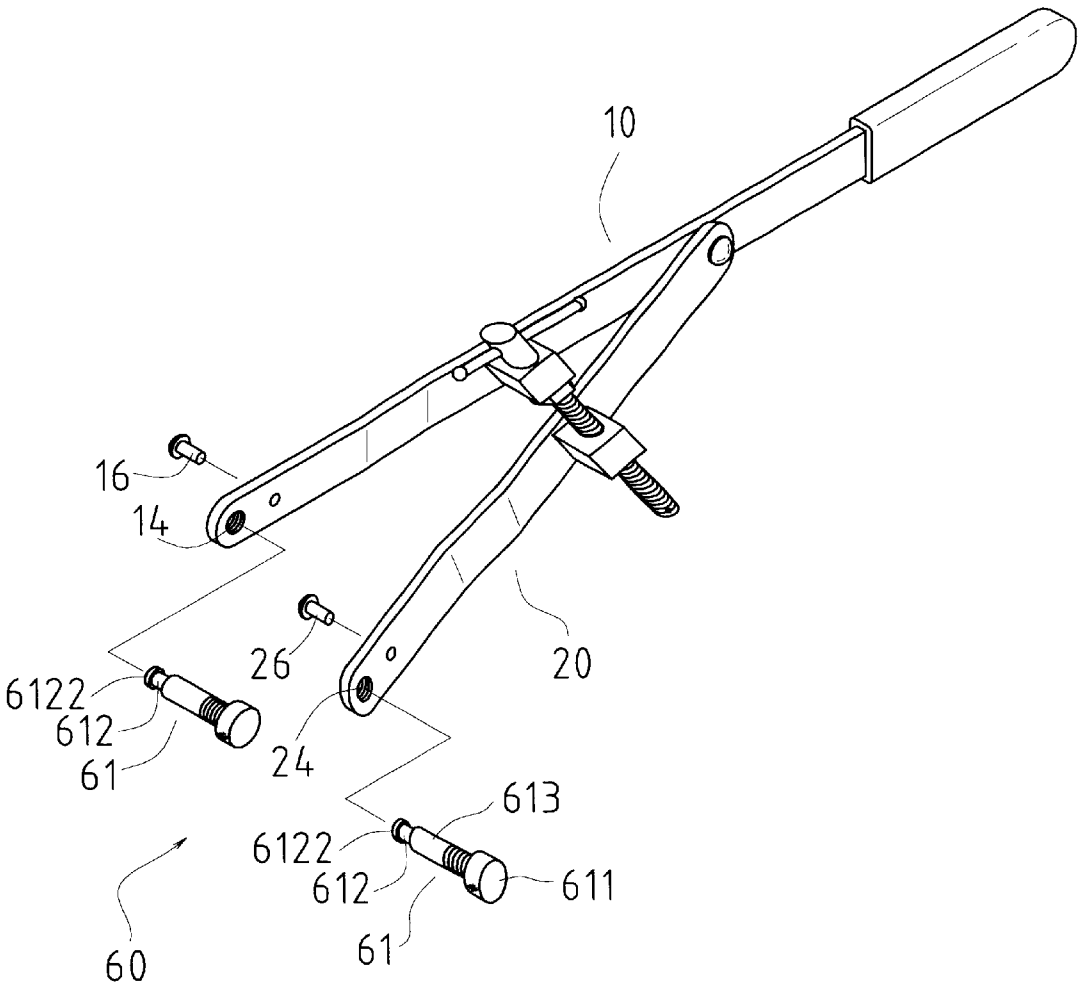
FIG. 10 is a perspective view of a holding wrench in accordance with a fourth embodiment of the present invention.

Referring to FIG. 10, in accordance with a fourth embodiment of the present invention, a third holding assembly 60 is selectively secured on the body and includes two third holding members 61 each having a threaded post 613 selectively screwed into the first screw hole 14 of the first arm plate 10 and the second screw hole 24 of the second arm plate 20 respectively, thereby selectively securing the two third holding members 61 to the first arm plate 10 and the second arm plate 20 respectively.

The threaded post 613 of each of the two third holding members 61 has a first end provided with an enlarged head 611 rested on a first side of the first screw hole 14 of the first arm plate 10 and the second screw hole 24 of the second arm plate 20 respectively, and has a second end formed with an insertion stub 612 protruded outward from a second side of the first screw hole 14 of the first arm plate 10 and the second screw hole 24 of the second arm plate 20 respectively. The insertion stub 612 has a distal end formed with an enlarged stub head 6122 to mate with workpieces of different structures.

In such a manner, the third holding assembly 60 can be used to mate with rotation workpieces of different structures.

Figure 11:
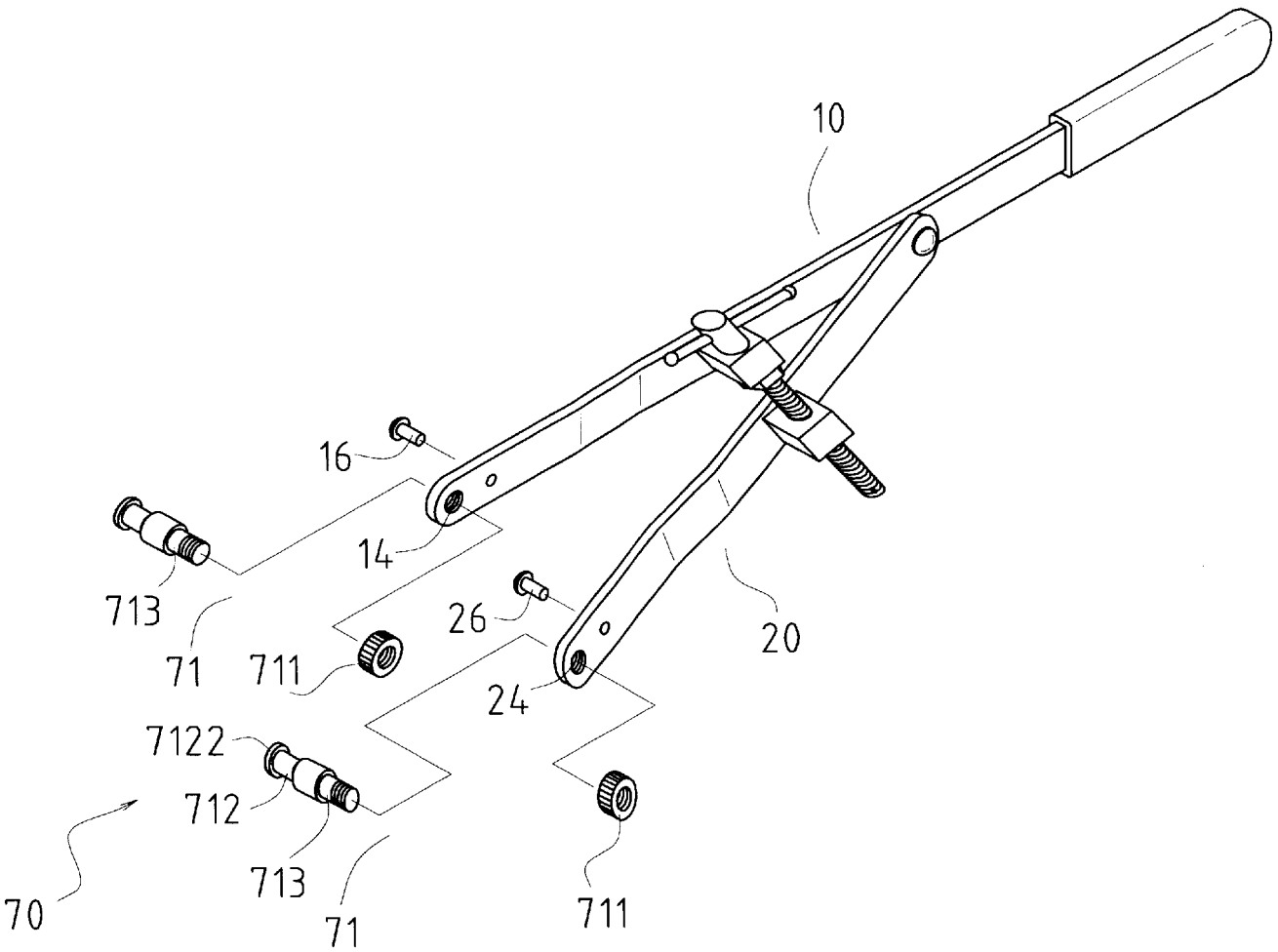
FIG. 11 is a perspective view of a holding wrench in accordance with a fifth embodiment of the present invention.

Referring to FIG. 11, in accordance with a fifth embodiment of the present invention, a fourth holding assembly 70 is selectively secured on the body and includes two fourth holding members 71 each having a threaded post 713 selectively screwed into the first screw hole 14 of the first arm plate 10 and the second screw hole 24 of the second arm plate 20 respectively, thereby selectively securing the two fourth holding members 71 to the first arm plate 10 and the second arm plate 20 respectively.

The threaded post 713 of each of the two fourth holding members 71 has a first end provided with an enlarged head 711 rested on a first side of the first screw hole 14 of the first arm plate 10 and the second screw hole 24 of the second arm plate 20 respectively, and has a second end formed with an insertion stub 712 protruded outward from a second side of the first screw hole 14 of the first arm plate 10 and the second screw hole 24 of the second arm plate 20 respectively. The enlarged head 711 is screwed on the first end of the threaded post 713. The insertion stub 712 has a distal end formed with an enlarged stub head 7122 to mate with workpieces of different structures.

In such a manner, the fourth holding assembly 70 can be used to mate with rotation workpieces of different structures.

Accordingly, in accordance with the present invention, the operator can select a proper holding assembly to combine with the body according to the shape and structure of the rotation workpiece that is to be assembled and dismantled, so as to satisfy the requirements of maintenance, without having to provide holding wrenches of different specifications and types, thereby greatly enhancing the convenience of operation. In addition, the regulating device 30 can be used to adjust the included angle between the first arm plate 10 and the second arm plate 20 in a stable and rigid manner, and can be used to efficiently secure and position the first arm plate 10 and the second arm plate 20, thereby preventing the first arm plate 10 and the second arm plate 20 from freely pivoting relative to each other unintentionally, thereby increasing the convenience during operation.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A holding wrench comprising:

a body, said body including a first arm plate (10) and a second arm plate (20), said first arm plate (10) having a first end provided with a handle (12) and a second end defining a first screw hole (14), said second arm plate (20) having a first end pivotally mounted on a mediate portion of said first arm plate (10) and a second end defining a second screw hole (24);

a first holding assembly (40) selectively secured on said body and including two symmetric first holding members (41) each having a first end selectively and releasably secured on said second end of said first arm plate (10) and said second arm plate (20), and each having a second end defining a snap recess (411), said snap recesses (411) of said two first holding members (41) facing each other, said first end of each of said two first holding members (41) defining a through hole (413) aligning with said first screw hole (14) of said first arm plate (10) and said second screw hole (24) of said second arm plate (20) respectively, two locking bolts (42) each respectively extended through said through hole (413) of each of said two first holding members (41), and each respectively screwed into said first screw hole (14) of said first arm plate (10) and said second screw hole (24) of said second arm plate (20), thereby securing said two first holding members (41) to said first arm plate (10) and said second arm plate (20) respectively; and a second holding assembly (50) selectively secured on said body and including two second holding members (51) each having a threaded post (513) selectively screwed into said first screw hole (14) of said first arm plate (10) and said second screw hole (24) of said second arm plate (20) respectively, thereby selectively securing said two second holding members (51) to said first arm plate (10) and said second arm plate (20) respectively, said threaded post (513) of each of said two second holding members (51) having a first end provided with an enlarged head (511) rested on a first side of said first screw hole (14) of said first arm plate (10) and said second screw hole (24) of said second arm plate (20) respectively, and having a second end formed with an insertion stub (512) protruded outward from a second side of said first screw hole (14) of said first arm plate (10) and said second screw hole (24) of said second arm plate (20) respectively.

2. The holding wrench in accordance with claim 1, wherein said first end of each of said two first holding members (41) defines a stub passage hole (412) located adjacent to said through hole (413), said first arm plate (10) is provided with a first locking stub (16) located adjacent to said first screw hole (14), and said second arm plate (20) is provided with a second locking stub (26) located adjacent to said second screw hole (24), said first locking stub (16) of said first arm plate (10) and said second locking stub (26) of said second arm plate (20) are respectively inserted into said stub passage holes (412) of said two first holding members (41), thereby positioning said two first holding members (41) on said first arm plate (10) and said second arm plate (20) respectively.

3. The holding wrench in accordance with claim 1, wherein said insertion stub has a distal end formed with an enlarged stub head to mate with rotation workpieces of different structures.

4. The holding wrench in accordance with claim 1, wherein said enlarged head is screwed on said first end of said threaded post.

5. The holding wrench in accordance with claim 1, further comprising a regulating device (30) including a first seat (31), a second seat (32), and a threaded rod (33), wherein, said first seat (31) is pivotally mounted on said first arm plate (10), said second seat (32) is pivotally mounted on said second arm plate (20), said threaded rod (33) has a first end extended through said first seat (31) and a second end extended through said second seat (32), an enlarged catch block (331) is secured on said first end of said threaded rod (33) and is rested on said first seat (31), a limit nut (333) is mounted on said threaded rod (33) and is located between said first seat (31) and said second seat (32), so that said first seat (31) is limited between said catch block (331) and said limit nut (333), a retaining pin (332) is secured on said second end of said threaded rod (33), so that said first seat (31) and said second seat (32) are limited between said catch block (331) and said retaining pin (332), a drive rod (3311) is transversely extended through said catch block (331) for rotating said threaded rod (33), so that said first seat (31) and said second seat (32) can be moved relative to each other, and so that said first arm plate (10) and said second arm plate (20) can be pivoted relative to each other.

6. The holding wrench in accordance with claim 5, wherein said first seat (31) has a side formed with a first nail (311) which is extended through said first arm plate (10) and is expanded to form a first head (312), so that said first seat (31) is pivoted on said first arm plate (10), and said second seat (32) has a side formed with a second nail (321) which is extended through said second arm plate (20) and is expanded to form a second head (322), so that said second seat (32) is pivoted on said second arm plate (20).

7. The holding wrench in accordance with claim 6, wherein said first nail (311) of said first seat (31) is pivoted with a first washer (313) located between said first head (312) and said first arm plate (10), and said second nail (321) of said second seat (32) is pivoted with a second washer (323) located between said second head (322) and said second arm plate (20).

* * * * *